US007880755B1

(12) United States Patent
Potash et al.

(10) Patent No.: US 7,880,755 B1
(45) Date of Patent: Feb. 1, 2011

(54) MULTI-SEGMENT MULTI-CHARACTER FIXED PRINT HEAD ASSEMBLY

(75) Inventors: Ellery W. Potash, Marietta, GA (US); Hideo Taniguchi, Kyoto (JP)

(73) Assignee: Lathem Time, Atlanta, GA (US)

( * ) Notice: Subject to any disclaimer, the term of this patent is extended or adjusted under 35 U.S.C. 154(b) by 95 days.

(21) Appl. No.: 12/426,192

(22) Filed: Apr. 17, 2009

Related U.S. Application Data

(60) Provisional application No. 61/045,880, filed on Apr. 17, 2008.

(51) Int. Cl.
*B41J 2/32* (2006.01)
*B41J 3/00* (2006.01)

(52) U.S. Cl. ..... 347/200

(58) Field of Classification Search ..... 346/78, 346/80; 347/200, 211
See application file for complete search history.

(56) References Cited

U.S. PATENT DOCUMENTS 3,934,695 A 1/1976 Kovalick
4,262,188 A 4/1981 Beach
4,475,112 A 10/1984 Washio et al.
4,660,052 A * 4/1987 Kaiya et al. ..... 347/200
4,777,583 A 10/1988 Minami et al.
4,789,870 A 12/1988 Lacord et al.
4,861,625 A 8/1989 Kondo et al.
4,944,983 A 7/1990 Nonoyama et al.
5,003,323 A * 3/1991 Onuki et al. ..... 347/171
5,514,524 A 5/1996 Ohnishi et al.
5,519,426 A 5/1996 Lokis et al.
5,995,127 A 11/1999 Uzuka
6,030,071 A 2/2000 Kompllin et al.
6,081,287 A 6/2000 Nosita et al.
6,344,868 B1 2/2002 Susukida et al.
6,558,563 B2 5/2003 Kashiwaya et al.
6,614,460 B2 9/2003 Susukida et al.

* cited by examiner

*Primary Examiner*—Huan H Tran
(74) *Attorney, Agent, or Firm*—George R. Reardon

(57) ABSTRACT

A thermal print head assembly comprising a thin ceramic substrate, a thermal insulating glaze layer, an electrically conducive layer, an electrically resistive element layer, and a glass over-coating protective layer, plus an energizing schema that eliminates the need for a heat-sink is disclosed. A method of making this thermal print head assembly is also disclosed.

20 Claims, 16 Drawing Sheets

300

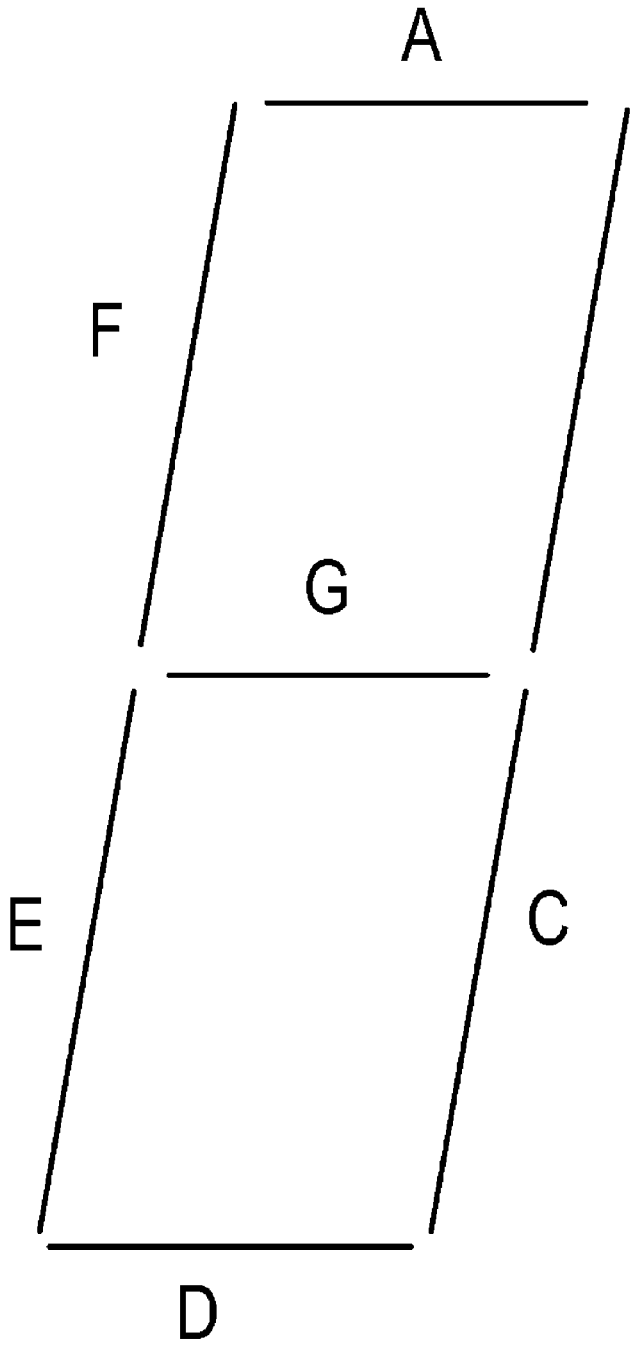
FIG. 5B1

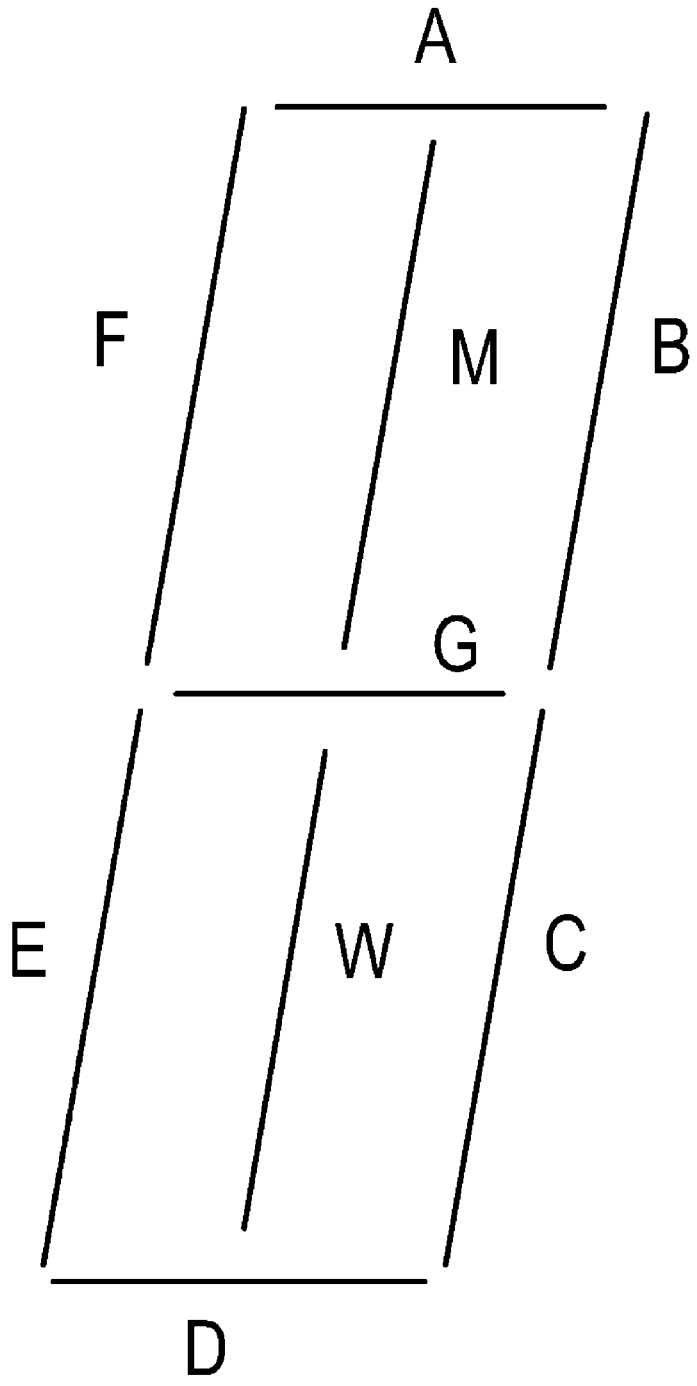
FIG. 5B2

MULTI-SEGMENT MULTI-CHARACTER FIXED PRINT HEAD ASSEMBLY

FIELD OF THE INVENTION

The technology described herein relates to a thermal print head comprising a thin ceramic substrate, a thermal insulating glaze layer, an electrically conducive layer, an electrically resistive element layer, and a glass over-coating protective layer, plus an energizing schema that eliminates the need for a heat-sink.

The technology described herein also relates to a method of manufacturing the thermal head of the kind mentioned above.

BACKGROUND OF THE INVENTION

Thermal printers work by selectively heating regions of special heat-sensitive paper. A thermal print head has a line of resistors, whose output is a line of precisely controlled dots of heat, which produce images in conjunction with heat-sensitive paper or ribbons.

A typical thermal printer traditionally has a thermal head (to generate heat and print on paper), a platen (a rubber roller that feeds paper), a spring (which applies pressure to the thermal head, causing it to contact thermo-sensitive paper), and at least one of a controller board (for controlling the mechanism). In order to print, one inserts thermo-sensitive paper between the thermal head and the platen. The printer sends an electrical current to the heating resistor of the thermal head which in turn generates heat in a prescribed pattern. The heat activates the thermo-sensitive coloring layer of the thermo-sensitive paper, which manifests a pattern of color change in response.

The paper is impregnated with a solid-state mixture of a dye and a suitable matrix, e.g. a combination of a fluoran leuco dye and an octadecylphosphonic acid. When the matrix is heated above its melting point, the dye reacts with the acid, shifts to its colored form, and the changed form is then conserved in meta-stable state when the matrix solidifies back quickly enough.

Controller boards are embedded with firmware to manage the thermal printer mechanisms. These controller boards' features are designed to meet the needs in terms of functionalities and specifications.

The firmware can manage multiple code types, graphics and logos. This enables a user to choose between different resident fonts and character sizes.

Controller boards can drive various sensors like paper low, paper out, door open, top of form etc., and they are available with the most commonly used interfaces (RS232, Parallel, USB, wireless).

Thermal print heads require a heat sink to dissipate the heat generated during printing, thus adding to manufacturing costs.

Most thermal printer applications employ a thermal print head having a linear array of thermal print cells (dots). In such application, either the thermal print head is held stationary and the thermal-sensitive paper is moved, or the paper is held stationary and the thermal print head is moved; one in contact with the other, at a controlled velocity and/or with feed-back to the controlling system indicating position and/or velocity while the controller selectively energizes the dots of the thermal print head to mark the paper passing against it.

Both of these situations are impractical for time & attendance applications where an employee will present his/her time card to the printing time clock manually. Unlike printers using roll-paper, a time clock with fixed print-head cannot precisely control the movement of a manually inserted time card without resorting to motion-control components of significant cost. Utilizing a moving print-head would require an active clamping mechanism to keep the time card stationary and a complex and costly means to precisely transport the print-head. By utilizing a multi-segment/multi-character fixed thermal print head, the number of mechanical and motion-control components is minimized, the need for precise motion control is eliminated, and the precisely-timed activation of thermal print segments can be easily and inexpensively controlled using current microcontroller technology.

U.S. patents directed to thermal print heads include the following.

U.S. Pat. No. 3,934,695, issued to Kovalick on Jan. 27, 1976, discloses the enhancement of the quality of thermally printed characters by controlling the time at which and the time for which power is applied to the resistive printing elements in a battery-operated moving-head thermal dot matrix printer. By sequentially strobing the elements in the pattern of the character to be formed as the print head moves across thermal sensitive paper, a high-quality slanted character is printed and parasitic losses are reduced. By inversely varying the time power is supplied to each dot as battery voltage varies, character quality is maintained and useful battery life is extended U.S. Pat. No. 4,262,188, issued to Beach on Apr. 14, 1981, discloses enhancing the uniformity of density of characters printed by thermal printers upon thermally sensitive paper by controlling the amount of energy supplied to the print head during subsequent printings before the print head has completely cooled to ambient temperature. To obtain the desired uniformity the energy supplied to the print head for subsequent printings is made proportional to the energy lost by cooling of the print head between printings. This results in the print head being reheated to substantially the same printing temperature for each printing of a character or character segment. By using a dot driver having an R-C circuit that recharges the capacitor between print pulses at a rate that is proportional to the thermal time constant of the print head, the energy stored by the capacitor can then be used to re-heat, or control the re-heating, of the print head to substantially the same selected print temperature. By maintaining the R-C charging time constant substantially between 0.1.tau. and .tau. (.tau. is the thermal time constant of the print head) the resultant printed character segments have substantially uniform density.

U.S. Pat. No. 4,475,112, issued to Washio et al. on Oct. 2, 1984, discloses a thermal printing head comprising an array of heating elements divided into two blocks each having alternate pairs of two adjacent heating elements, the two blocks being further divided into eight subblocks. The pairs of two adjacent heating elements are supplied with electric power through power feed lines each shared by such a pair of two adjacent heating elements. Two adjacent heating elements belonging to the two blocks are drivable by a single driver. Therefore, the number of the power feed lines and the drivers can be reduced. The eight subblocks are driven two at a time in one cycle of operation, and hence can be energized by a limited allowable current supplied to the thermal printing head.

U.S. Pat. No. 4,777,583, issued to Minami et al. on Oct. 11, 1988, discloses a thermal head comprising a ceramic substrate, a glaze layer partially formed on the ceramic substrate, heat-generating resistors and electrodes connected to both the ends of the heat-generating resistors, if the width of individual electrodes located outside the glaze layer is made narrower than the width of corresponding electrodes on the glaze layer, formation of a short circuit between adjacent individual electrodes because of the presence of voids on the ceramic substrate can be effectively prevented.

U.S. Pat. No. 4,789,870, issued to Lacord et al. on Dec. 6, 1988 discloses a thermal series type printing head that is controlled on-the-fly, during a succession of cycles of a duration at most equal to the time for printing the points, so as to be heated independently during the first half and during the second half of each cycle. Thus an offset dot can be printed of half a length of a normal dot, or an extended dot, one and half times as long as the normal dot, for improving the definition of printing without reducing the writing speed. The invention applies to printing systems, particularly for printers connected to word processing devices.

U.S. Pat. No. 4,861,625, issued to Kondo et al. on Aug. 29, 1989 discloses a method of manufacturing a partially-glazed ceramic substrate for use in a thermal printing head. A ceramic substrate having a surface roughness of 0.2 .mu.m or less is provided. Subsequently, a glaze is applied to the ceramic substrate to form raised glaze regions having a transverse width of 1.0 mm or less and thickness of 100 .mu.m or less. The substrate and glaze are baked, and then a heating element is formed on the raised glaze regions.

U.S. Pat. No. 4,944,983, issued to Nonoyama et al. on Jul. 31, 1990 discloses a sloped substrate for a thermal head made of ceramic for a thermal head of a thermosensitive printing device, in which a sloped surface of 200 .mu.m to 2,000 .mu.m in width is formed between a main plane surface of the substrate and a subplane surface thereof and a glaze is bonded by firing to the main plane and the subplane surfaces and the sloped surface so that the thickness of the glaze is 100 .mu.m or less.

U.S. Pat. No. 5,514,524, issued to Ohnishi et al. on May 7, 1996, discloses a method of making thermal printheads is provided which comprises the steps of: (a) preparing a master substrate having plural rows of unit head regions; (b) forming a head glaze member in each unit head region in each row so that an edge of the head glaze member of the unit head region aligned with that of the head glaze member of any other unit region in the same row; (c) half-cutting the master substrate along the edge of the head glaze member of the unit head region with a half-cutting dicing blade which has an inclined edge face for partially cutting the head glaze member to provide a glaze corner; and (d) forming an array of heating dots along the glaze corner; wherein at least one blade positioning mark is formed on the master substrate before the half-cutting step (c); and the half-cutting dicing blade is positionally set in the half-cutting step (c) by referring to the blade positioning mark.

U.S. Pat. No. 5,519,426, issued to Lokis et al. on May 21, 1996, discloses a method for controlling binary thermal printers which increases the effective output resolution of the thermal printer above the native resolution of a print head having a plurality of individual resistive heating elements arranged in a print line. An increase in the effective resolution of a binary output image is achieved by using an overdrive energy to control a relative position of a binary edge of a pixel image at a resolution that is less than the native resolution of the thermal printer. In a preferred embodiment, an under-drive energy may also be used with an adjacent over-drive energy to further control the relative position of the binary image of the pixel image. The over-drive energy is higher than a native pixel drive energy, but lower than a maximum drive energy. The native pixel drive energy produces a binary pixel image having a native area corresponding to the native resolution of the thermal printer. The binary pixel image on the print media corresponding to the heating elements to which the over-drive energy is applied are increased in area beyond the native area of the thermal printer, thereby enabling the thermal printer to realize an increase in an effective resolution of the binary image.

U.S. Pat. No. 5,995,127, issued to Uzuka on Nov. 30, 1999, discloses a thermal print head with a supporting substrate, a glaze layer formed on the substrate, a heating resistor which is formed on the glaze layer and made of Si and O and the rest being substantially composed of a metal, and electrodes connected to the heating resistor. The heating resistor has an unpaired electron density of 1.0.times.10.sup.19/cm.sup.3. In addition, the reaction layer formed by reaction of the glaze layer and the heating resistor is formed between the glaze layer and resistor.

U.S. Pat. No. 6,030,071, issued to Komplin et al. on Feb. 29, 2000, discloses a printhead comprising a plate having a plurality of orifices through which ink droplets are ejected and a heater chip coupled to the plate. The heater chip includes a plurality of heating elements and first and second conductors for providing energy to the heating elements. The first and second conductors are arranged in spaced-apart planes and/or in a matrix.

U.S. Pat. No. 6,081,287, issued to Nosita et al. on Jun. 27, 2000, discloses a thermal head having a protective film of a heater formed on the heater, the protective film comprising a ceramic-based lower protective layer composed of at least one sub-layer and a carbon-based upper protective layer formed on the lower protective layer, wherein a surface of the lower protective layer on which the upper protective layer is to be formed has a surface roughness value Ra of 0.005 to 0.5 .mu.m; or the one in which the depth of a depression step which may be formed on the surface of the lower protective layer due to the thickness of the electrodes used for supplying power to the heater (or heat-generating resistor) was reduced to 0.2 .mu.m or less. Therefore, the thermal head has a protective film which has significantly reduced corrosion and wear, which is advantageously protected from cracks and peeling-off due to heat and mechanical impact and which allows the thermal head to have a sufficient durability to exhibit high reliability over an extended period of time, thereby ensuring that the thermal recording of high-quality images is consistently performed over an extended period of operation.

U.S. Pat. No. 6,344,868, issued to Susukida et al. on Feb. 5, 2002, discloses a thermal head including a protection layer having mutually opposed first and second surfaces, the first surface having a flat or protruded printing surface which is brought into contact with a heat sensitive record medium, a heat generating section including resistors and electrodes connected to the electrodes and provided on the second surface of the protection layer, and a reinforcing member made of a low melting pint glass and provided on a side of the heat generating section remote from the protection layer. The reinforcing member improves a mechanical strength of the thermal head. The reinforcing member made of a glass also serves as a heat storage member, and thus a thermal property of the thermal head is improved. The reinforcing member may be formed by an aggregate of ceramic particles. The reinforcing member may contain a heat storage layer made of a low melting point glass and a heat conduction layer provided on the heat storage layer.

U.S. Pat. No. 6,558,563, issued to Kashiwaya et al. on May 6, 2003, discloses a thermal head fabricating method which forms a lower protective layer made of ceramics for protecting a plurality of heat-generating resistors and electrodes, subjects the lower protective layer to etching processing by a plasma and forms a carbon protective layer on the thus subjected lower protective layer. The etching processing is performed using a mask which defines an area where the carbon protective layer is formed, a protective layer is formed on a surface of the mask, and the protective layer is made of a material which is etched at an extremely slow rate or substantially not etched compared with ceramics composing the lower protective layer and/or which does not impart an adverse effect to the carbon protective layer that is subsequently formed.

U.S. Pat. No. 6,614,460, issued to Susukida et al. on Sep. 2, 2003, discloses a thermal head including a protection layer having mutually opposed first and second surfaces, the first surface having a flat or protruded printing surface which is brought into contact with a heat sensitive record medium, a heat generating section including resistors and electrodes connected to the electrodes and provided on the second surface of the protection layer, and a reinforcing member made of a low melting pint glass and provided on a side of the heat generating section remote from the protection layer. The reinforcing member improves a mechanical strength of the thermal head. The reinforcing member made of a glass also serves as a heat storage member, and thus a thermal property of the thermal head is improved. The reinforcing member may be formed by an aggregate of ceramic particles. The reinforcing member may contain a heat storage layer made of a low melting point glass and a heat conduction layer provided on the heat storage layer.

While these patents and other previous methods have attempted to solve the problems that they addressed, none have utilized or disclosed a multi-segment, multi-character thermal print head assembly and energizing schema which eliminates the need for a heat-sink.

Therefore, a need exists for a solution to the above problems. The attributes and functionalities of the technology described herein provide this solution. The print head assembly according to embodiments of the invention substantially departs from the conventional concepts and designs of the prior art. It can be appreciated that there exists a continuing need for a new and improved print head assembly which can be used commercially. In this regard, the technology described herein substantially fulfills these objectives.

The foregoing information reflects the state of the art of which the inventors are aware and is tendered with a view toward discharging the inventors' acknowledged duty of candor in disclosing information that may be pertinent to the patentability of the technology described herein. It is respectfully stipulated, however, that the foregoing information do not teach or render obvious, singly or when considered in combination, the inventors' claimed invention.

BRIEF SUMMARY OF THE INVENTION

The general purpose of the technology described herein, which will be described subsequently in greater detail, is to provide a multi-segment, multi-character fixed thermal print head assembly directed to eliminating the need for a heat-sink.

In general, the technology described herein:

a) has wafer-thin geometry
b) has a unique energizing schema which significantly reduces heat accumulation
c) is capable of attachment to a printed wire board of its control circuit without the requirement of a heat-sink
d) can use standard assembly methods for the attachment of surface-mount integrated circuits to a printed wire board, and
e) eliminates the need for interconnecting wires or ribbon cables to the control circuit.

In an exemplary embodiment the technology described herein is designed to support 53 linear thermal segments arranged to form alphabetic and numeric characters and punctuation; each requiring application of 24 v DC into a nominal 100-ohm impedance for a 12.5 mSec duration. To energize all 53 segments simultaneously requires the switching of 13 Amps into a 305-Watt load (worst case scenario). This requires a large and expensive 400-Watt power supply with provisions for heat removal and large and expensive heat-sink provisions to remove the heat from the thermal print head (which would otherwise damage the metal segments, ceramic substrate and interconnect features due to unequal thermal expansion of these materials). Such heat presents a safety hazard to a user and requires a substantially larger enclosure to provide thermal management capabilities. Additionally, switching of large currents creates large spikes of electromotive force and generates Electro-Magnetic Interference that harms radio broadcasts and violates FCC regulations.

The multi-segment, multi-character thermal print head employed in the technology disclosed herein is based upon a ceramic substrate with approximate dimension 30 mm long×7 mm wide×0.8 mm thick, upon which are applied (using a screening process) a thermal insulating glaze layer, an electrically conducive layer, an electrically resistive element layer and glass over-coating protective layer in succession.

The substrate is heat-treated in a high temperature furnace after each layer is applied so that the material will have excellent cohesion with the ceramic. It is the resistive elements that rise in temperature when electrically energized via conductive elements that route the electric current from the module's interconnect contacts to the thermal segments.

Aspects of the technology disclosed herein are the deposition of a primary glazing layer for thermal control and the physical layout of the thermal segments to allow a wide variety of print options, e.g., suitable to a time & attendance application. For example, the characters are arranged in the format of one 9-segment character followed by six 7-segment characters. A colon, with independently-controllable dots, appears between the third and fourth 7-segment characters. This arrangement enables the thermal print head to create an imprint such as "WE12:34 A", to indicate a transaction on Wednesday at 12:34 AM. The first two characters are capable of presenting the seven day-of-week abbreviations in English, Spanish and French, as well as "HO" or "Ho" to indicate a holiday. Independent control of the dots that comprise the colon character allows activation of the lower-dot only, in order to present a decimal point. This flexibility allows the time of 15-minutes past 9-o'clock to be presented as "9:15", or as "9.25" (for those payroll administrators who find it easier to tabulate time-card totals when the minutes are represented as hundredths-of-hours).

An aspect of the technology described herein is that it is directed to eliminating a heat-sink for a thermal print head.

Another aspect of the technology described herein is that it is directed to wafer-thin geometry for a thermal print head assembly.

Another aspect of the technology described herein is that it is directed to the attaching of a thermal print head control circuit to a printed wire board.

Another aspect of the technology discribed herein is that it is directed to using standard assembly methods for the attachment of surface-mount integrated circuits to a printed wire board for a thermal print head.

Another aspect of the technology described herein is that it may be used commercially.

Another aspect of the technology described herein is that it may be economically produced.

These and other features and advantages of the technology described herein will be presented in more detail in the following specification of the technology disclosed herein and the accompanying figures, which illustrate by way of example the principles of the technology disclosed herein.

There are additional features of the technology disclosed herein that will be described hereinafter and which will form the subject matter of the claims appended hereto. In this respect, before explaining at least one embodiment of the technology disclosed herein in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the technology described herein. It is important, therefore, that the claims be regarded as including such equivalent constructions insofar as they do not depart from the spirit and scope of the technology described herein.

BRIEF DESCRIPTION OF THE SEVERAL VIEWS OF THE DRAWINGS

The technology described herein, together with further advantages thereof, may best be understood by reference to the following description taken in conjunction with the accompanying drawings in which:

FIG. 5B1 illustrates 7-segment thermal print head character fonts, according to an embodiment of the technology described herein.

FIG. 5B2 illustrates 9-segment thermal print head character fonts, according to an embodiment of the technology described herein.

DETAILED DESCRIPTION OF THE INVENTION

The technology described herein will now be described in detail with reference to a few preferred embodiments thereof as illustrated in the accompanying drawings. In the following description, numerous specific details are set forth in order to provide a thorough understanding of the technology described herein. It will be apparent, however, to one skilled in the art, that the technology described herein may be practiced without some or all of these specific details. In other instances, well known operations have not been described in detail so not to unnecessarily obscure the technology described herein.

Referring now to FIG. 1A through FIG. 6, in a typical embodiment of the technology described herein the geometry of the font (illustrated in FIGS. 1A-1E) provides print quality that is better than previous designs/methods due to minimized gaps among segments. This design is less sensitive to screen printing alignment tolerance issues and the ceramic substrate can be made smaller. Also, when misalignment effect is reduced, product reliability increases. These factors help to increase process and material efficiencies which reduces manufacturing costs. This design allows for only one electrode per segment while previous design/method required two electrodes; thus, reducing the requirement of a gap between the heating element segments by approximately 50%. In addition to the unique arrangement and configuration of the thermal print head segments and interconnects illustrated in FIGS. 1A-1E, the technology disclosed herein employs a number of design features that render the thermal print head smaller, more reliable, more aesthetically appealing and less costly to deploy than those previously developed.

Figure 1A:
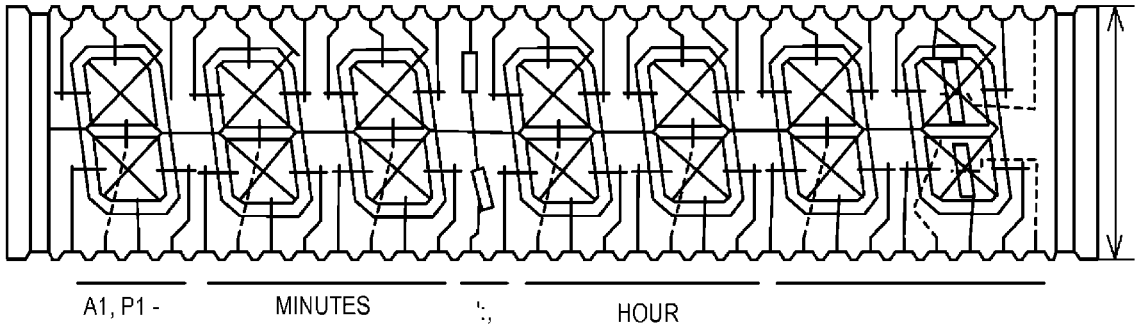
FIG. 1A illustrates a top plan view of a basic geometry for a thermal print head, according to an embodiment of the technology described herein.
Figure 1B:
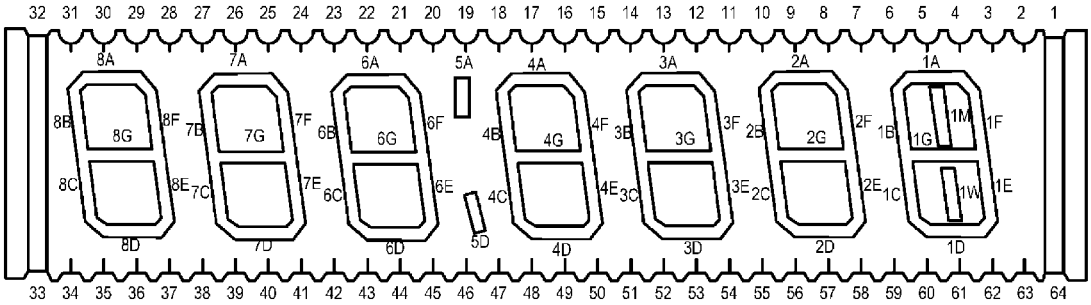
FIG. 1B illustrates a top plan view of a basic geometry for a thermal print head illustrating thermal head reference numbers, according to an embodiment of the technology described herein.
Figure 1C:
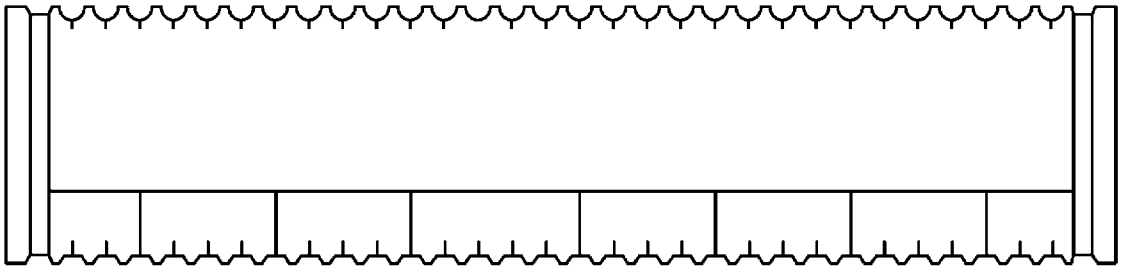
FIG. 1C illustrates a bottom plan view of a thermal print head illustrating basic geometry, dimensions and spacing, according to an embodiment of the technology described herein.
Figure 1D:
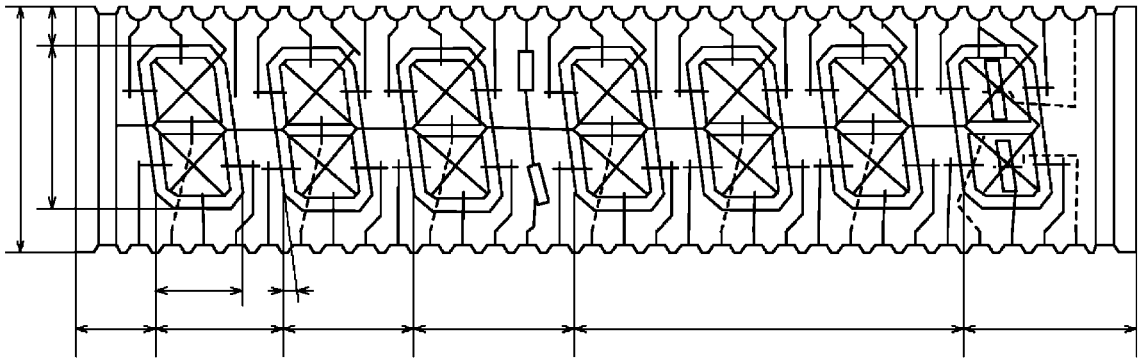
FIG. 1D illustrates a top plan view and a side plan view of a thermal print head illustrating basic geometry and key position dimensions, according to an embodiment of the technology described herein.
Figure 1E:
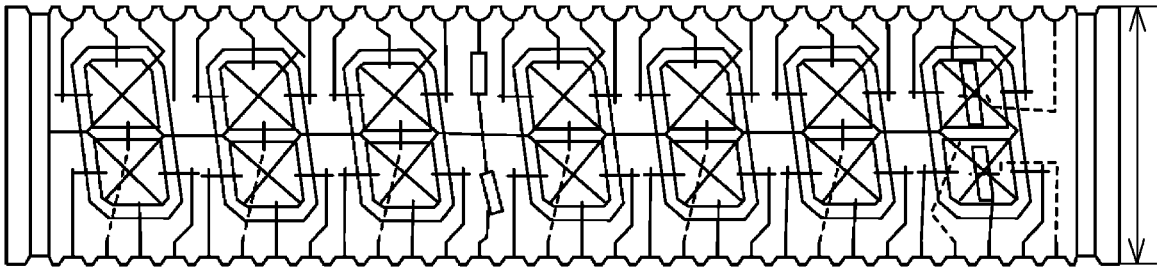
FIG. 1E illustrates a top plan view of a thermal print head illustrating basic geometry and main wiring parts dimensions, according to an embodiment of the technology described herein.
Figure 2:
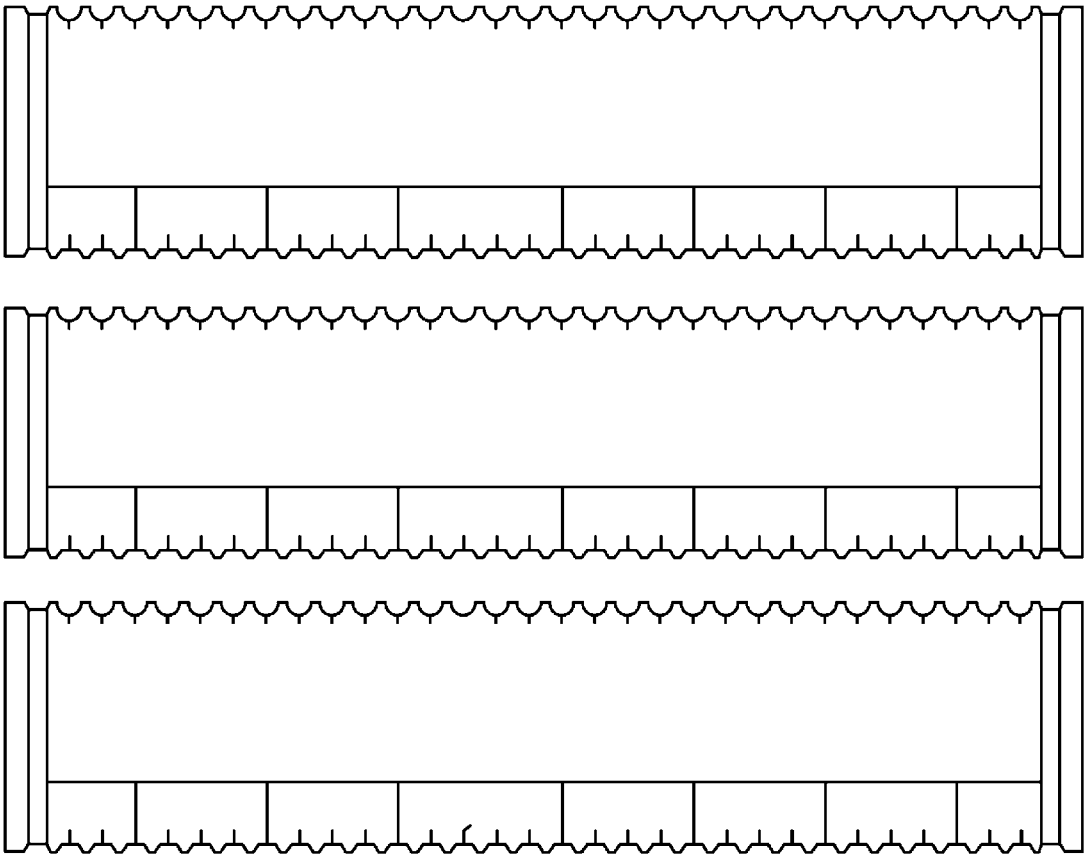
FIG. 2 illustrates separation of ceramic wafers from sheet substrate by laser scribing (laser drilling and scoring), according to an embodiment of the technology described.

With reference to FIGS. 1A through 1E, these include:

a) The ability to energize and heat a portion of the continuous and closed circuited heating element. Prior art does not have a closed circuit.

b) The closed-circuit geometry creates a plurality of heating elements, e.g. a figure '8' is comprised of two (2) closed circuits (loops); besides the figure '8', a variety of other alpha and numeric characters and logo marks can be printed.

c) The printing character consists of one common electrode and a plurality of individual heating element electrodes. (FIG. 1C shows a back-side metallization in which a plurality of contact points to the common electrode is provided, in order to expand and disburse the current path across several printed wire board conductive traces.

Figure 3A:
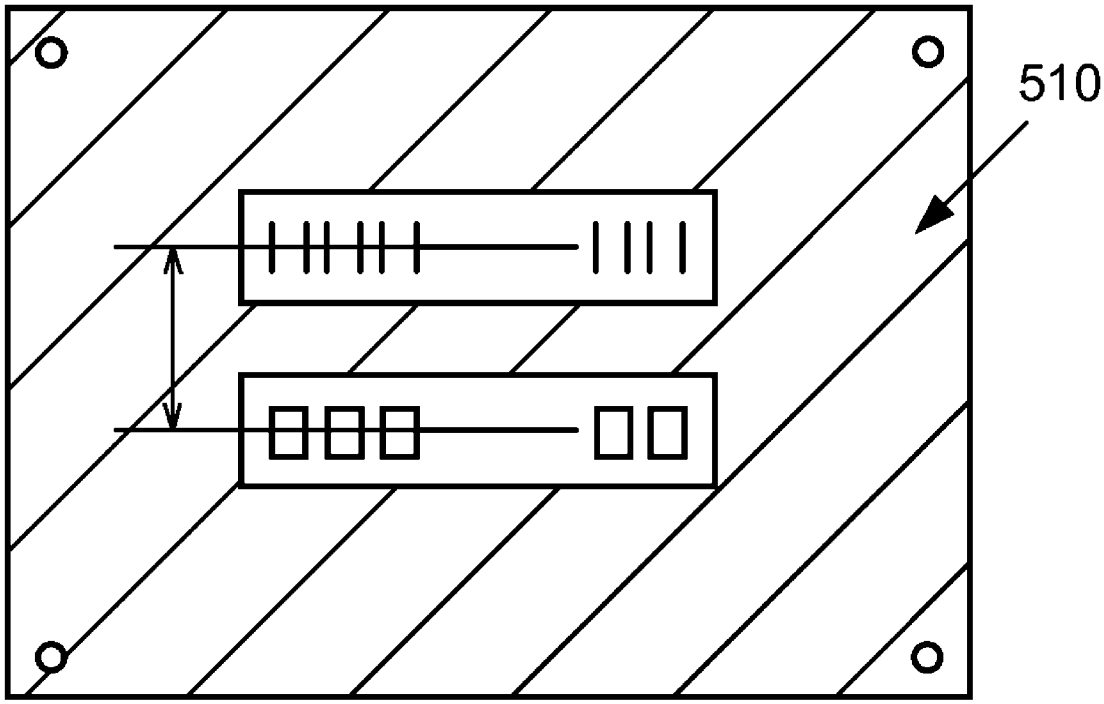
FIG. 3A, FIG. 3B, FIG. 3C and FIG. 3D illustrate several views of a thermal print head bonded to a printed wiring board using surface mount technology, according to an embodiment of the technology described herein.
Figure 3B:
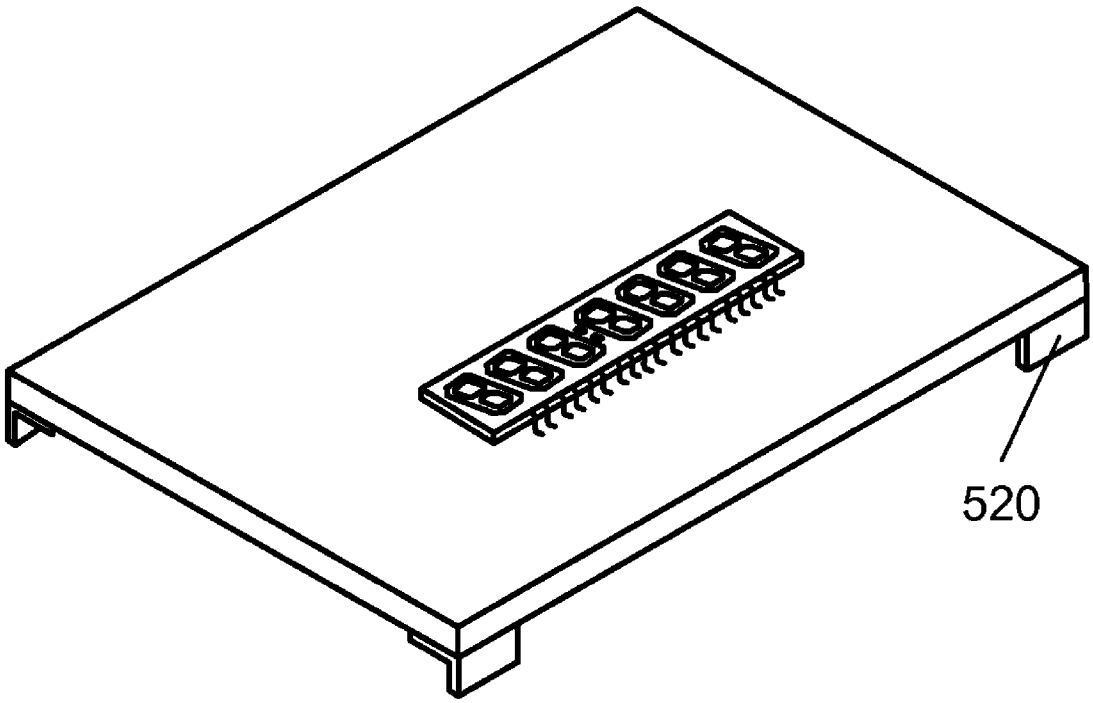
Figure 3C:
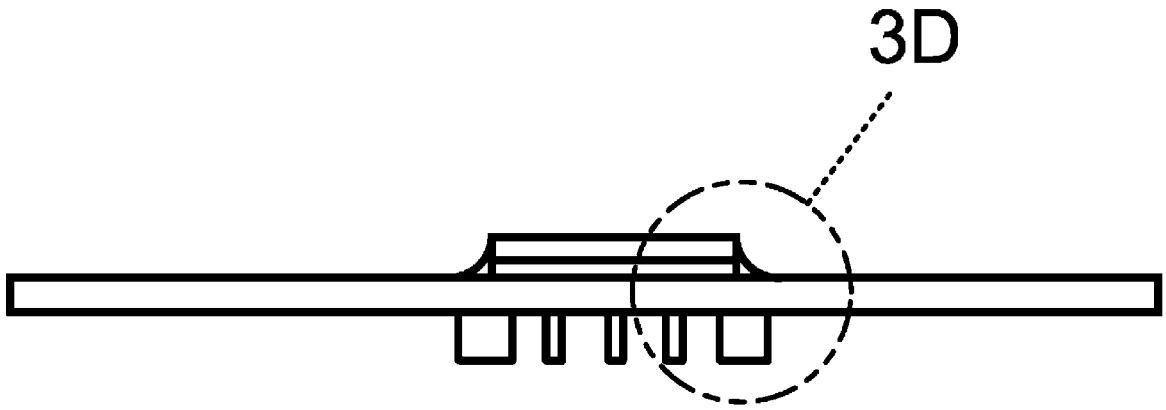
Figure 3D:
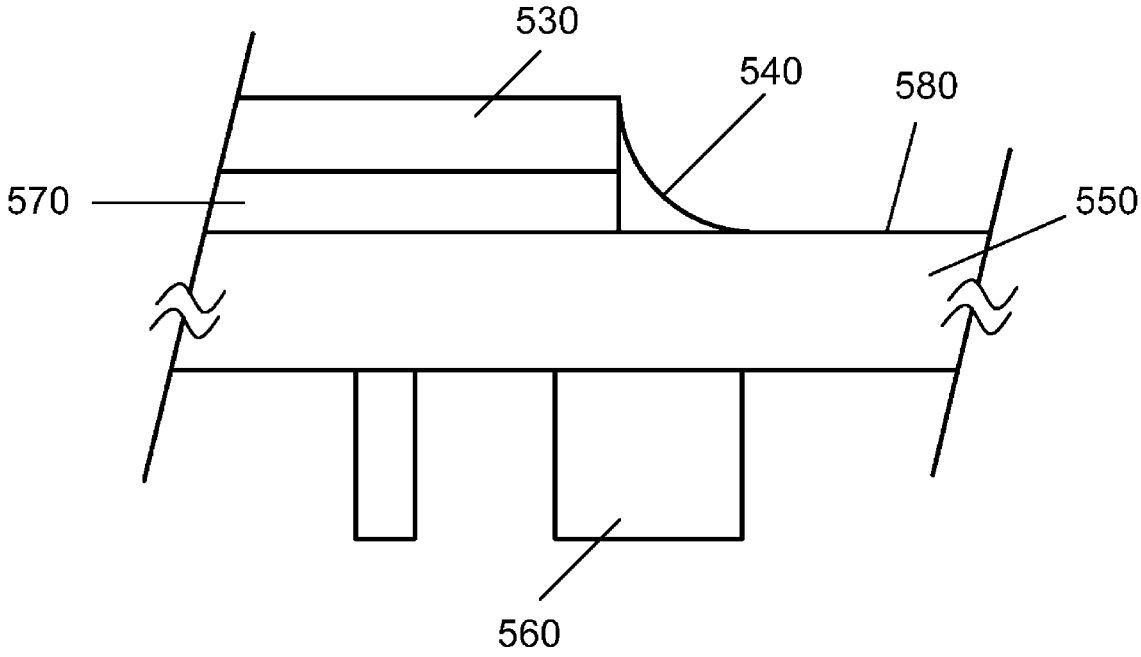

These can be reduced to a single point of contact if it is desirable to reduce the number of connection points.)

d) Four corners of the heating elements (segments) are formed to a multi-angle or curved shape, so that the common electrodes can cross mid-point, at a perpendicular angle, promoting even, balanced current flow through the element. These stylings also reduce the broken appearance of a figure's segments and makes the printed font easier to read.

e) The amount of energy required to render a visually acceptable image on thermal paper is proportional to the length and width of each heating element. With the technology described herein proportionally larger and smaller print heads can be manufactured and utilized, providing that the applied energy is controlled according to the dimensions of the heating elements.

f) For any particular size of thermal print head using this technology, the intensity of the rendered thermal image and, to some extent, the length and width of the printed segments, may be adjusted by controlling the applied energy. This control occurs by varying the voltage level, the single on-off time and/or string of on-off time, the duty cycle, and by incorporating the thermal history, i.e., the history of recent segment energizing affecting retained heat, into the on-the-fly determination of applied pulse-width. FIG. 3A illustrates a copper pour metal surface power plane and heat sink 510. FIG. 3B illustrates a fastener 520. FIG. 3D illustrates a HIT Thermal Print Head 530, a solder filet 540, a copper plane 580 on a PC board surface, where the copper plane is a heat sink, a control circuit PC board 550, a SMT driver circuit component 560, and a thermal conductive pad or conductive paste 570. Referring to FIGS. 3A, 3B, 3C and 3D, with regard to an exemplary embodiment of the thermal print head, because of its 0.8 mm wafer-thin geometry and a unique energizing schema that significantly reduces heat accumulation in the device, it is possible to attach the component to the printed wire board of its control circuit without the requirement of a heat-sink, using standard assembly methods developed for the attachment of surface-mount integrated circuits to printed wire boards. Not only is the size, weight, bulk and cost of the heat-sink eliminated, but mounting restrictions are eased and the need for interconnecting wires or ribbon cables to the control circuit is also eliminated (which potentially reduces electromagnetic interference).

g) There is a thermal insulation layer (not shown) under the heating resistive element. This glaze layer prevents heat-loss and helps reduce the driving energy requirement.

In order to reduce power supply requirements, reduce electromagnetic interference and reduce heat build-up that results from dissipating high power in the thermal print head load, a unique schema of selectively energizing desired segments in segment groups, e.g. by character, in a serial sequence (rather than energizing all desired segments simultaneously) has been developed. While this mimics the scan and multiplex methods that have been historically used to drive multi-digit seven-segment LED displays, the technology disclosed herein represents the first time that these methods have been employed for the purpose of energizing the segments of a thermal print head. Timing of the scan and energization phases of the operation is in accordance with the requirements and limitations of the staionary thermal print head (which is substantially different than that of a LED display application).

The following is an illustrative example to demonstrate the implementation of the technology disclosed herein:

Referring to FIGS. 5A, 5B1 and 5B2, printing the digits "12345678" would require shifting into the thermal print head driver the following segment patterns (where a '1' indicates that the segment is to be energized and a '0' indicates that the segment is to be off):

| Char. | Bit # --> Segment --> | 8 — | 7 g | 6 f | 5 e | 4 d | 3 c | 2 b | 1 a |
|---|---|---|---|---|---|---|---|---|---|
| 1 | | 0 | 0 | 0 | 0 | 0 | 1 | 1 | 0 |
| 2 | | 0 | 1 | 0 | 1 | 1 | 0 | 1 | 1 |
| 3 | | 0 | 1 | 0 | 0 | 1 | 1 | 1 | 1 |
| 4 | | 0 | 1 | 1 | 0 | 0 | 1 | 1 | 0 |
| 5 | | 0 | 1 | 1 | 0 | 1 | 1 | 0 | 1 |
| 6 | | 0 | 1 | 1 | 1 | 1 | 1 | 0 | 1 |
| 7 | | 0 | 0 | 0 | 0 | 0 | 1 | 1 | 1 |
| 8 | | 0 | 1 | 1 | 1 | 1 | 1 | 1 | 1 |

Counting the '1' bits in the chart, above, it can be seen that there are 38 Segments to be energized. Were these to be energized simultaneously, the draw of approximately 240 mA/segment would cause a total draw of 9.12 Amps, or 219 Watts at 24-volts.

By using the bit serial load or byte serial load method of the thermal print head the effect is to present a 64-bit pattern to the Segment Drivers when the shifted bytes are latched, as follows:

```
        6666655555555554444444444333333333322222222221111111111
Bit#-->4321098765432109876543210987654321098765432109876543210987654321
Seg:   0111111100000111011111101011011010110011001001111010110110000011 0
Char: <-- 8 --><-- 7 --><-- 6 --><-- 5 --><-- 4 --><-- 3 --><-- 2 --><--
 1 -->
```

The technology disclosed herein provides a schema for energizing a sub-group of the total requirement at any one time. Using certain driver integrated circuits it is possible to shift all 64 bits, as shown above, and then selectively and sequentially energize portions of the total, e.g., groups of 8, 16 or 32 bits. Using the driver integrated circuit illustrated in FIG. 5A, which does not support the ability to selectively enable portions of the whole, the following schema is proposed, illustrating a schema of energizing two (2) characters simultaneously:

```
        6666655555555554444444444333333333322222222221111111111
Bit#-->4321098765432109876543210987654321098765432109876543210987654321
```

-continued

```
        During a first phase:
Seg:    0000000000000000000000000000000000000000000000000101101100000110
Char:                                                   <-- 2 --><--
 1 -->
        During a second phase:
Seg:    0000000000000000000000000000000011001100100111100000000000000000
Char:                                   <-- 4 --><-- 3 -->
        During a third phase:
Seg:    0000000000000000111110101101101000000000000000000000000000000000
Char:                   <-- 6 --><-- 5 -->
        During a fourth phase:
Seg:    0111111100000111000000000000000000000000000000000000000000000000
Char:   <-- 8 --><-- 7 -->
```

It should be noted that no more than two (2) characters are simultaneously energized and, with an average of only 4.75 active segments per character, the average simultaneous current draw is (4.75 segments×2 characters)×240 mA/Segment=2.28 Amps (=54.72 W at 24 v); current, power and heat are reduced by a factor of four (4), compared to the prior method.

Taking advantage of the Serial Shift Register architecture that is typical of thermal print head controllers (FIG. 5A), it is a feature of the technology described herein that one can reduce the number of shifts and increase processing speed by taking advantage of the '0' bits already in the shift register as are retained at the conclusion of the prior shift operation. Thus, the number of bit-shift operations can be reduced below the apparent 4×64=256 (or 32 byte-shift operations). Utilizing this method, the following are examples of the necessary shifts needed to execute the patterns of the prior illustration:

```
Shift #1 (64 bits):
0000000000000000000000000000000000000000000000000101101100000110
Shift Reg Contents:
0000000000000000000000000000000000000000000000000101101100000110
Shift #2 (48 bits):
 000000000000000000000000000000000110011001001111
Shift Reg Contents:
0000000000000000000000000000000011001100100111100000000000000000
Shift #3 (32 bits): 00000000000000000111110101101101
Shift Reg Contents:
0000000000000000111110101101101000000000000000000000000000000000
Shift #4 (48 bits):
 011111110000011100000000000000000000000000000000
Shift Reg Contents:
0111111100000111000000000000000000000000000000000000000000000000
      ----------------------------
         192 bit-shift operations
          24 byte-shift operations
```

Alternately, preceding each shift sequence with a chip reset operation, which fills the shift register with all 0 bits:

```
Reset:
0000000000000000000000000000000000000000000000000000000000000000
Shift #1 (64 bits):
0000000000000000000000000000000000000000000000001011011000001100
Shift Reg Contents:
0000000000000000000000000000000000000000000000001011011000001100
Reset:
0000000000000000000000000000000000000000000000000000000000000000
Shift #23 (48 bits):
 000000000000000000000000000000000110011001001111
Shift Reg Contents:
0000000000000000000000000000000011001100100111100000000000000000
Reset:
0000000000000000000000000000000000000000000000000000000000000000
Shift #3 (32 bits): 00000000000000000111110101101101
```

-continued

```
Shift Reg Contents:
0000000000000000111110101101101000000000000000000000000000000000
Reset:
0000000000000000000000000000000000000000000000000000000000000000
Shift #4 (16 bits): 0111111100000111
Shift Regr Contents:
0111111100000111000000000000000000000000000000000000000000000000
      ----------------------------
         160 bit-shift + 4 Reset operations
          20 byte-shift + 4 Reset operations
```

To minimize the number of electronic assemblies within a thermal print head device, e.g. a time clock, as well as the number of interconnecting cable systems between the assemblies, the technology disclosed herein includes the product's control circuits, user interface (audible and visual indicators, character/graphic display), thermal print head driver circuits and the themal print head within a single printed wiring board assembly.

This feat is achieved by the unique method of surface-mounting the ceramic thermal print head to one side of a printed wiring board (PWB) and its control circuit to the opposite side of that same board. Furthermore, that sub-assembly is directly connected to the main control printed wiring board which supports the user interface using board-to-board connectors, and taking advantage of a package geometry that allows the positioning of these electronic devices all within the upper, fixed portion of the Time Clock. The lower, moving portion of the illustrative time clock contains the mechanical actuators that transfer the user's thumb pressure upon a hinged platform to actuate a time card clamping feature, elevate a printing platen into place, and to trigger the electronics to energize the themal print head according to the schema of this technology disclosed herein.

Figure 4A:
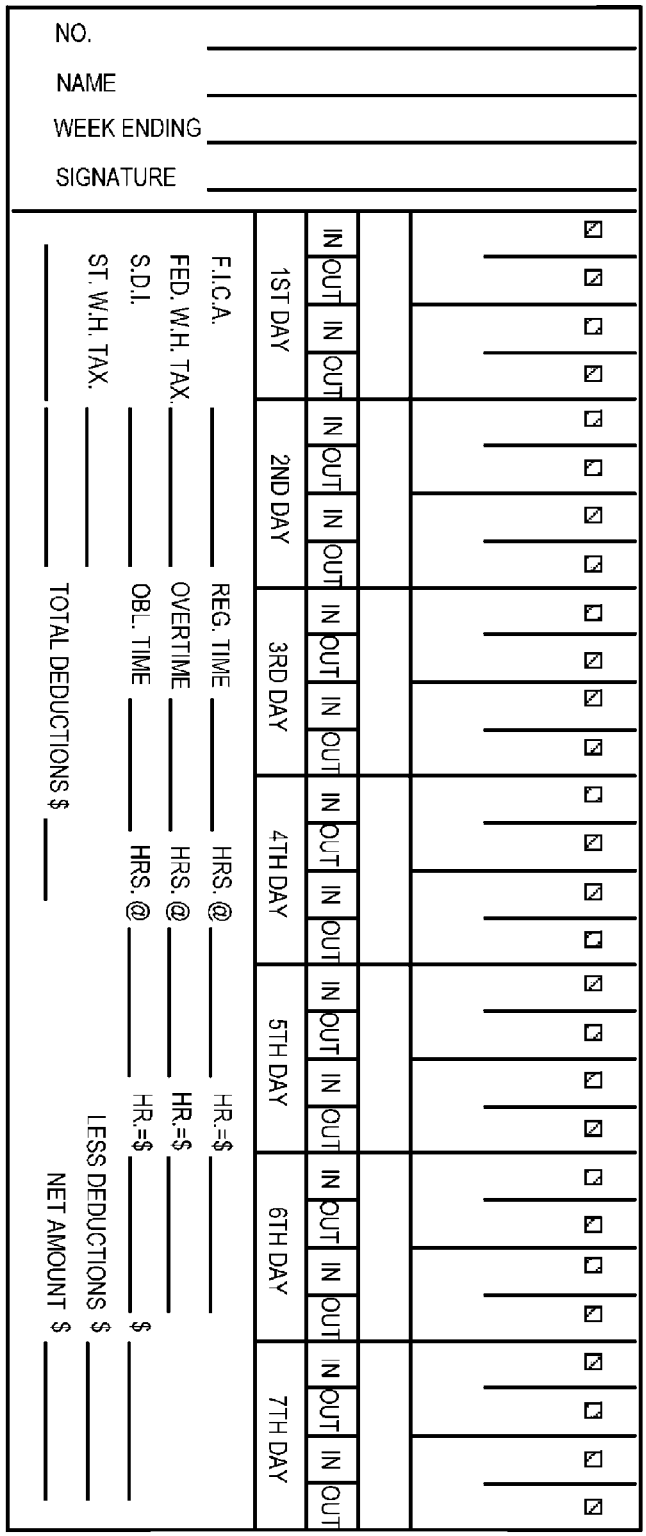
FIG. 4A illustrates a single-edged time card having print cell alignment marks, for use in a time and attendance device employing a thermal print head, according to an embodiment of the technology described herein.
Figure 4B:
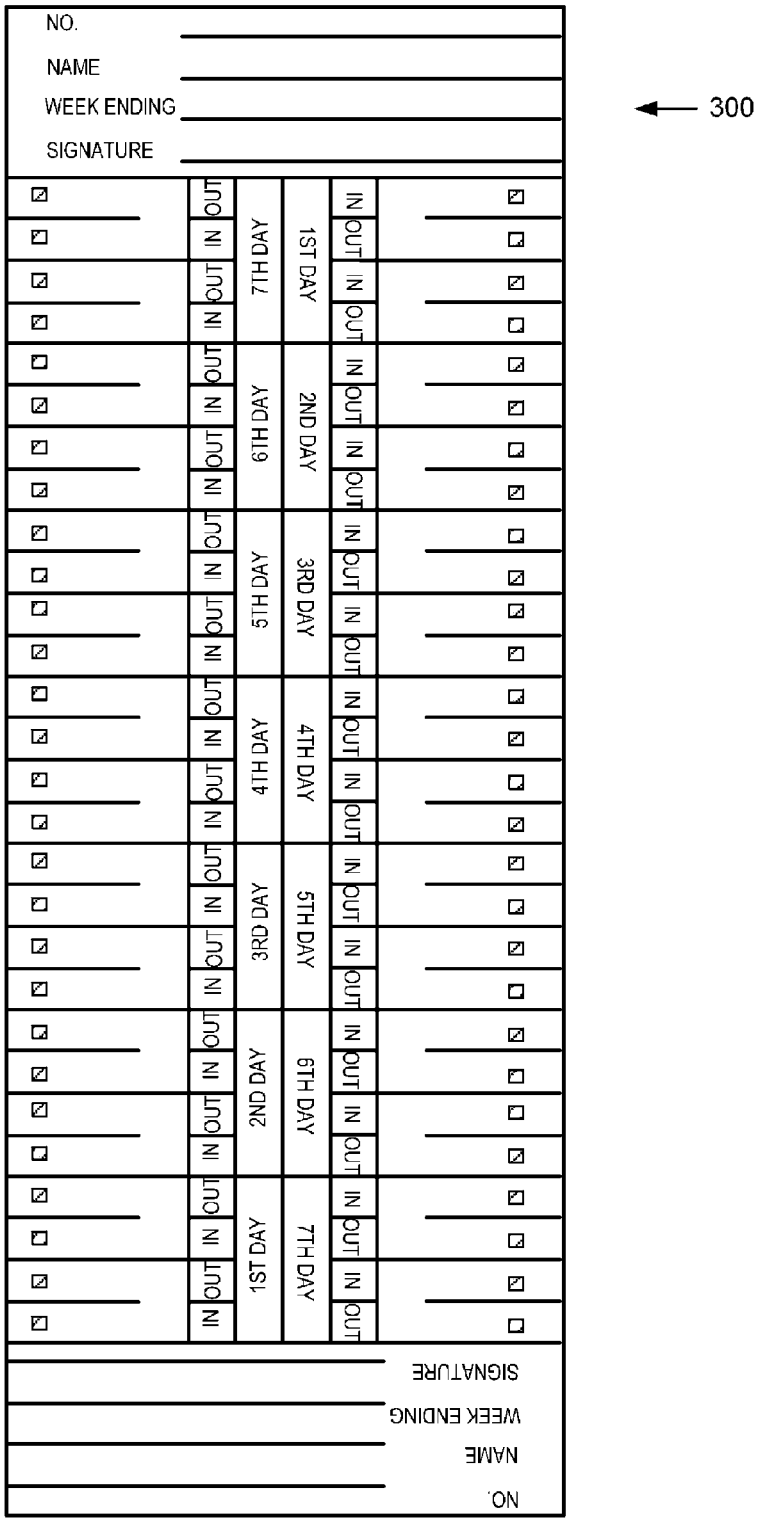
FIG. 4B illustrates a double-edged time card having print cell alignment marks, for use in a time and attendance device employing a thermal print head, according to an embodiment of the technology described herein.
Figure 5A:
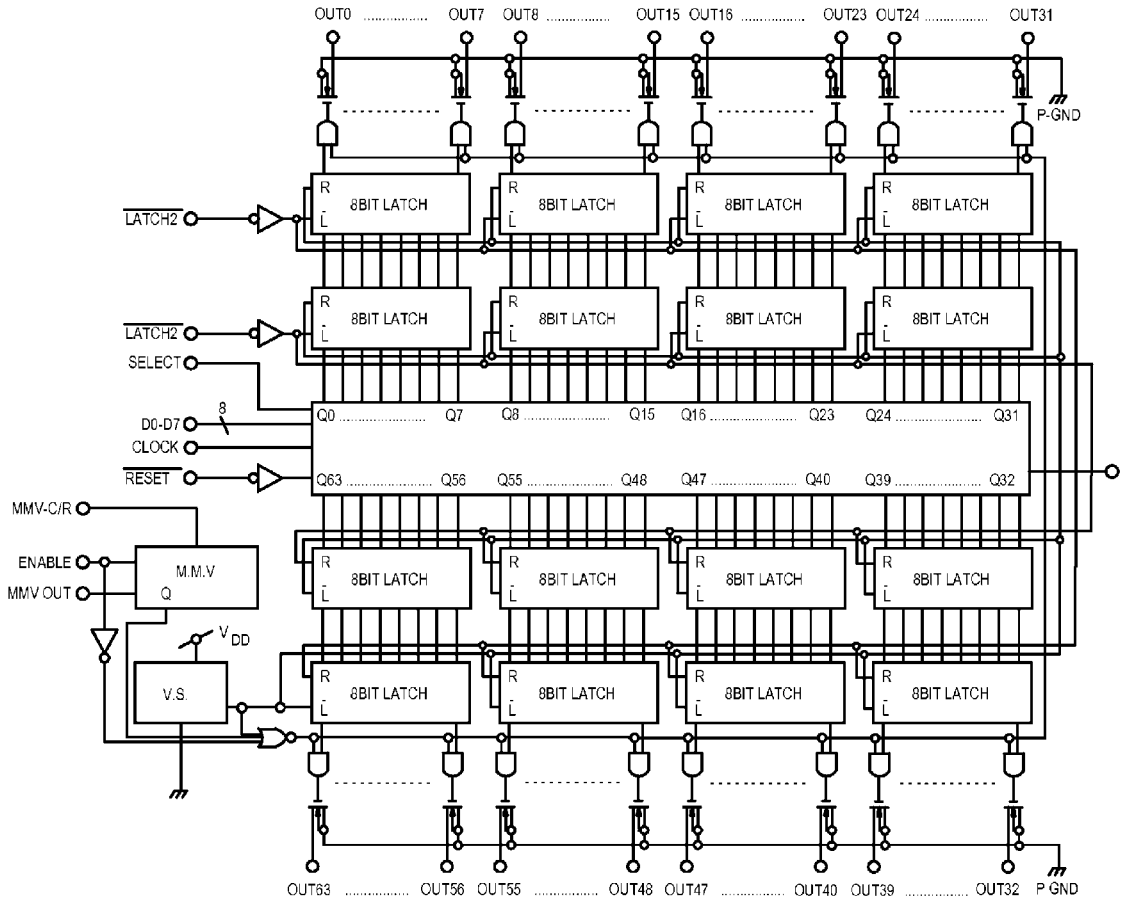
FIG. 5A illustrates a thermal print head driver having a 64-segment shift register and latches, according to an embodiment of the technology described herein.
Figure 6:
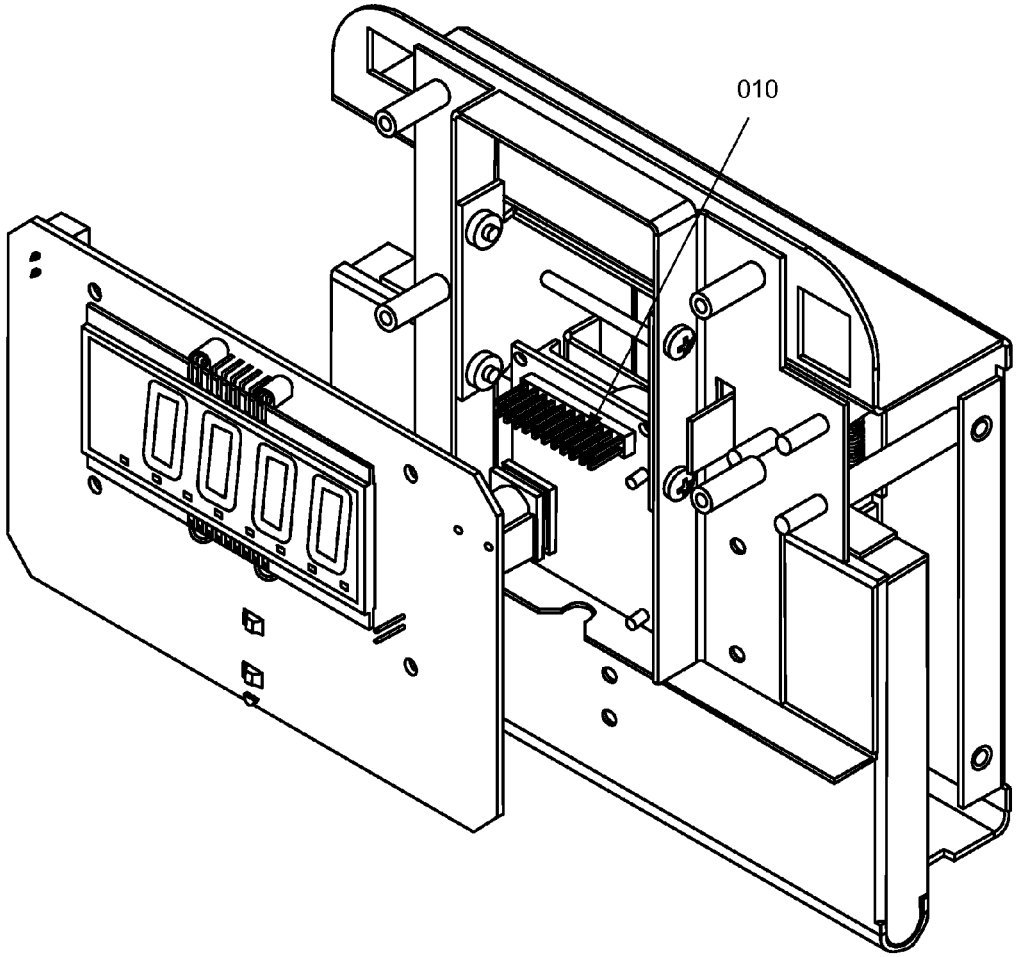
FIG. 6 illustrates a partial exploded view of a time and attendance device employing a thermal print head, according to an embodiment of the technology described herein.

This arrangement allows a user, using only one hand, to hold and present a time card to the printing time clock, insert it into the receiver slot (whether wall- or table-mounted), and to press downward onto the hinged receiver platform to secure the card and activate the print function. FIGS. 4A and 4B illustrate a time card 300 upon which the technology described herein imprints.

The technology described herein can also be described according to the following items:

1. A multi-segment, multi-character fixed thermal print head assembly 010, for devices with manually-inserted media, the print head assembly comprising:
   i. a substantially thin ceramic substrate upon which a multi-segment, multi-character fixed thermal print head for devices with manually-inserted media is fabricated;
   ii. a thermal insulating glaze layer, layered upon the ceramic substrate and configured to provide thermal control to the multi-segment, multi-character fixed thermal print head assembly;
   iii. an electrically conducive layer, layered upon the thermal insulating glaze layer;
   iv. an electrically resistive element layer, layered upon the electrically conducive layer; and
   v. a glass overcoating protective layer layered upon the electrically resistive element layer.
2. The multi-segment, multi-character fixed thermal print head assembly, for devices with manually-inserted media of item 1, where the ceramic substrate is heat-treated in a high temperature furnace after each layer is applied to provide increased cohesion of each layer to the ceramic substrate.
3. The multi-segment, multi-character fixed thermal print head assembly, for devices with manually-inserted media of item 1, where the multi-segment, multi-character fixed thermal print head is further comprised of:
   i. a plurality of segments configured to be interchangeably energized to form one or more of a plurality of characters arranged in a format of one nine-segment character and six seven-segment characters.
4. The multi-segment, multi-character fixed thermal print head assembly, for devices with manually-inserted media of item 3, further comprising:
   i. independently controllable segment dots energized for either for a period or a colon, dependent on a time notation format desired, the segments dots being located between the third and fourth seven-segment characters of the six seven-segment characters.
5. The multi-segment, multi-character fixed thermal print head assembly, for devices with manually-inserted media of item 3, where the one or more of a plurality of characters are configured to present the seven day-of-week abbreviations in English, Spanish, and French, and are additionally configured to present a notation representing a holiday.
6. The multi-segment, multi-character fixed thermal print head assembly, for devices with manually-inserted media of item 1, where the segments of the multi-segment, multi-character fixed thermal print head are energized in character-based sub-groups.
7. The multi-segment, multi-character fixed thermal print head assembly, for devices with manually-inserted media of item 1, where an arrangement of the segments is comprised of a font having substantially minimal gaps between the segments, thereby configured to provide an improved print quality and configured to be less sensitive to alignment tolerance issues.
8. The multi-segment, multi-character fixed thermal print head assembly, for devices with manually-inserted media of item 1, where each segment is energized by a single electrode.
9. The multi-segment, multi-character fixed thermal print head assembly, for devices with manually-inserted media of item 1, further comprising:
   i. a continuous-circuit geometry;
   ii. a closed-circuit geometry; and
   iii. a plurality of segments created by the closed-circuit geometry;
   iv. where a portion of a continuous and closed-circuited segment is energized.
10. The multi-segment, multi-character fixed thermal print head assembly, for devices with manually-inserted media of item 1, where each segment is comprised of four corners and where each corner is constructed to a curved shape such that any of a plurality of common electrodes utilized cross mid-point, at a perpendicular angle, to promote an even, balanced current flow through the segment and thereby reduce any broken appearance of the segments of a character.

11. The multi-segment, multi-character fixed thermal print head assembly, for devices with manually-inserted media of item 1, where the multi-segment, multi-character fixed thermal print head is further comprised of fifty-three linear thermal segments configured to form alphabetic and numeric characters and punctuation.

12. A method for bonding a multi-segment, multi-character fixed thermal print head assembly to a control circuit board, the method comprising:
   i. utilizing a multi-segment, multi-character fixed thermal print head assembly; and
   ii. mounting the multi-segment, multi-character fixed thermal print head assembly directly to a control circuit board by surface mount.

13. The method for bonding a multi-segment, multi-character fixed thermal print head assembly to a control circuit board of item 12, further comprising:
   i. utilizing a copper plane, located on the control circuit board and upon which the multi-segment, multi-character fixed thermal print head assembly is mounted, configured to serve as a power-plane and a heat-sink to the multi-segment, multi-character fixed thermal print head assembly.

14. The method for bonding a multi-segment, multi-character fixed thermal print head assembly to a control circuit board of item 12, further comprising:
   i. a thermally conductive paste, placed between the multi-segment, multi-character fixed thermal print head assembly and the control circuit board.

15. The method for bonding a multi-segment, multi-character fixed thermal print head assembly to a control circuit board of item 12, further comprising:
   i. a thermally conductive pad, placed between the multi-segment, multi-character fixed thermal print head assembly and the control circuit board.

16. A method for sequentially scanning and energizing, in a serial sequence, portions of a segment display in a thermal print head, the method comprising:
   i. utilizing a multi-segment, multi-character fixed thermal print head assembly;
   ii. selectively energizing, in a serial sequence, one or more of the segments of multi-segment, multi-character fixed thermal print head in a character-based sub-group, thereby minimizing total instantaneous current flow, reducing power supply requirements, minimizing a need for thermal dissipation, and reducing electromagnetic interference being generated.

17. The method for sequentially scanning and energizing, in a serial sequence, portions of a segment display in a thermal print head of item 16, where no more than two characters are simultaneously energized.

18. The method for sequentially scanning and energizing, in a serial sequence, portions of a segment display in a thermal print head of item 16,
   i. utilizing a thermal print head driver integrated circuit to selectively and sequentially energize a portion of a total of segments required; and
   ii. selectively and sequentially energizing, in a serial sequence, non-simultaneously, any remaining segments of the total of segments required.

19. The method for sequentially scanning and energizing, in a serial sequence, portions of a segment display in a thermal print head of item 16, further comprising:
   i. a microcontroller configured to supervise a thermal print head print pattern and a sequence timing for printing, where the microcontroller transmits only a portion at a time of a total of segments in a full array of segments required for a print pattern to the thermal print head.

20. The method for sequentially scanning and energizing, in a serial sequence, portions of a segment display in a thermal print head of item 19, where the portion of total of segments in a full array of segments required for a print pattern is energized for a substantially brief period of time and where the process is repeated until all sub-groups have been energized and the print pattern is printed by the thermal print head.

From the foregoing, it will be appreciated that, although specific embodiments of the invention have been described herein for purposes of illustration, various modifications may be made without deviating from the spirit and scope of the invention. For example, many of the features and components described above in the context of a particular security platform and system configuration can be incorporated into other configurations in accordance with other embodiments of the invention. Accordingly, the invention is not limited except by the appended claims.

What is claimed is:

1. A multi-segment, multi-character fixed thermal print head assembly, for devices with manually-inserted media, the print head assembly comprising:
   a substantially thin ceramic substrate upon which a multi-segment, multi-character fixed thermal print head for devices with manually-inserted media is fabricated;
   a thermal insulating glaze layer, layered upon the ceramic substrate and configured to provide thermal control to the multi-segment, multi-character fixed thermal print head assembly;
   an electrically conducive layer, layered upon the thermal insulating glaze layer;
   an electrically resistive element layer, layered upon the electrically conducive layer; and
   a glass overcoating protective layer layered upon the electrically resistive element layer.

2. The multi-segment, multi-character fixed thermal print head assembly, for devices with manually-inserted media of claim 1, wherein the ceramic substrate is heat-treated in a high temperature furnace after each layer is applied to provide increased cohesion of each layer to the ceramic substrate.

3. The multi-segment, multi-character fixed thermal print head assembly, for devices with manually-inserted media of claim 1, wherein the multi-segment, multi-character fixed thermal print head is further comprised of:
   a plurality of segments configured to be interchangeably energized to form one or more of a plurality of characters arranged in a format of one nine-segment character and six seven-segment characters.

4. The multi-segment, multi-character fixed thermal print head assembly, for devices with manually-inserted media of claim 3, further comprising:
   independently controllable segment dots energized for either for a period or a colon, dependent on a time notation format desired, the segments dots being located between the third and fourth seven-segment characters of the six seven-segment characters.

5. The multi-segment, multi-character fixed thermal print head assembly, for devices with manually-inserted media of claim 3, wherein the one or more of a plurality of characters are configured to present the seven day-of-week abbreviations in English, Spanish, and French, and are additionally configured to present a notation representing a holiday.

6. The multi-segment, multi-character fixed thermal print head assembly, for devices with manually-inserted media of claim 1, wherein the segments of the multi-segment, multi-character fixed thermal print head are energized in character-based sub-groups.

7. The multi-segment, multi-character fixed thermal print head assembly, for devices with manually-inserted media of claim 1, wherein an arrangement of the segments is comprised of a font having substantially minimal gaps between the segments, thereby configured to provide an improved print quality and configured to be less sensitive to alignment tolerance issues.

8. The multi-segment, multi-character fixed thermal print head assembly, for devices with manually-inserted media of claim 1, wherein each segment is energized by a single electrode.

9. The multi-segment, multi-character fixed thermal print head assembly, for devices with manually-inserted media of claim 1, further comprising:

a continuous-circuit geometry;

a closed-circuit geometry; and a plurality of segments created by the closed-circuit geometry;

wherein a portion of a continuous and closed-circuited segment is energized.

10. The multi-segment, multi-character fixed thermal print head assembly, for devices with manually-inserted media of claim 1, wherein each segment is comprised of four corners and wherein each corner is constructed to a curved shape such that any of a plurality of common electrodes utilized cross mid-point, at a perpendicular angle, to promote an even, balanced current flow through the segment and thereby reduce any broken appearance of the segments of a character.

11. The multi-segment, multi-character fixed thermal print head assembly, for devices with manually-inserted media of claim 1, wherein the multi-segment, multi-character fixed thermal print head is further comprised of fifty-three linear thermal segments configured to form alphabetic and numeric characters and punctuation.

12. A method for bonding a multi-segment, multi-character fixed thermal print head assembly to a control circuit board, the method comprising:

utilizing a multi-segment, multi-character fixed thermal print head assembly; and mounting the multi-segment, multi-character fixed thermal print head assembly directly to a control circuit board by surface mount.

13. The method for bonding a multi-segment, multi-character fixed thermal print head assembly to a control circuit board of claim 12, further comprising:

utilizing a copper plane, located on the control circuit board and upon which the multi-segment, multi-character fixed thermal print head assembly is mounted, configured to serve as a power-plane and a heat-sink to the multi-segment, multi-character fixed thermal print head assembly.

14. The method for bonding a multi-segment, multi-character fixed thermal print head assembly to a control circuit board of claim 12, further comprising:

a thermally conductive paste, placed between the multi-segment, multi-character fixed thermal print head assembly and the control circuit board.

15. The method for bonding a multi-segment, multi-character fixed thermal print head assembly to a control circuit board of claim 12, further comprising:

a thermally conductive pad, placed between the multi-segment, multi-character fixed thermal print head assembly and the control circuit board.

16. A method for sequentially scanning and energizing, in a serial sequence, portions of a segment display in a thermal print head, the method comprising:

utilizing a multi-segment, multi-character fixed thermal print head assembly;

selectively energizing, in a serial sequence, one or more of the segments of multi-segment, multi-character fixed thermal print head in a character-based sub-group, thereby minimizing total instantaneous current flow, reducing power supply requirements, minimizing a need for thermal dissipation, and reducing electromagnetic interference being generated.

17. The method for sequentially scanning and energizing, in a serial sequence, portions of a segment display in a thermal print head of claim 16, wherein no more than two characters are simultaneously energized.

18. The method for sequentially scanning and energizing, in a serial sequence, portions of a segment display in a thermal print head of claim 16, utilizing a thermal print head driver integrated circuit to selectively and sequentially energize a portion of a total of segments required; and selectively and sequentially energizing, in a serial sequence, non-simultaneously, any remaining segments of the total of segments required.

19. The method for sequentially scanning and energizing, in a serial sequence, portions of a segment display in a thermal print head of claim 16, further comprising:

a microcontroller configured to supervise a thermal print head print pattern and a sequence timing for printing, wherein the microcontroller transmits only a portion at a time of a total of segments in a full array of segments required for a print pattern to the thermal print head.

20. The method for sequentially scanning and energizing, in a serial sequence, portions of a segment display in a thermal print head of claim 19, wherein the portion of total of segments in a full array of segments required for a print pattern is energized for a substantially brief period of time and wherein the process is repeated until all sub-groups have been energized and the print pattern is printed by the thermal print head.

* * * * *